United States Patent [19]

Genuit

[11] Patent Number: 4,694,241

[45] Date of Patent: Sep. 15, 1987

[54] TRANSFORMER TAP CHANGER

[75] Inventor: Luther L. Genuit, Scottsdale, Ariz.

[73] Assignee: Honeywell Bull Inc., Phoenix, Ariz.

[21] Appl. No.: 871,344

[22] Filed: Jun. 6, 1986

[51] Int. Cl.[4] ..... H01F 21/12; H01F 33/00

[52] U.S. Cl. ..... 323/340; 323/309; 323/361; 336/10; 336/107; 336/150

[58] Field of Search ..... 336/5, 10, 12, 150, 336/145, 146, 147, 105, 107; 323/309, 340, 361

[56] References Cited

U.S. PATENT DOCUMENTS 726,831 4/1903 Moody ..... 336/10

1,291,078 1/1919 Moody ..... 336/147

*Primary Examiner*—Thomas J. Kozma

*Attorney, Agent, or Firm*—A. A. Sapelli; J. S. Solakian

[57] ABSTRACT

One of a plurality of taps of at least one transformer is selected by choosing a predetermined plug to mate with a predetermined jack. The connection arrangement between each transformer and a corresponding jack is such that each pin of a respective jack is operatively connected to a predetermined transformer tap of the corresponding transformer whereby the corresponding taps of each of the transformers are connected to different corresponding pins for each of the corresponding jacks. Further, the starting tap of each transformer is operatively connected to the same corresponding pin of the jack corresponding to the transformer. A plurality of plugs, the number of plugs corresponding to one less than the number of pins of the jacks, is included whereby each plug has a plurality of mating pins corresponding to the pins of the jack. Each mating pin of each plug which corresponds to the pin of the starting tap is operatively connected to a first supply terminal. Each plug has a different mating pin from all of the other plugs operatively connected to a second supply terminal.

5 Claims, 5 Drawing Figures

TRANSFORMER TAP CHANGER

BACKGROUND OF THE INVENTION

This invention relates to an inductor device, and more particularly, to a transformer having connections whereby changes in coil length are readily achievable.

Large manufacturing firms with markets all over the world are finding it necessary to provide equipment that is capable of operating from a variety of power sources of different voltages and frequencies. Equipment with a relatively high kilovolt-amp (KVA) rating such as large computers are commonly connected to three-phase power lines. In the United States the common three-phase power source is 208 volts, line-line at sixty hertz. In England and most of the United Kingdom the common three-phase power source is 415 volts, line-line at fifty hertz. Continental Europe supplies power at fifty hertz and at 220 volts line-line or at 380 volts, line-line, depending on the particular location. In Japan the common voltage is 200 volts line-line. The frequency in Japan is fifty hertz in some locations and sixty hertz in others.

Because the destination of a particular piece of equipment is not generally known at the time of its manufacture, and also because equipment standardization tends to yield lower manufacturing costs, it is desirable that a single equipment design should be able to accommodate as many of the various world voltages and frequencies as possible, and that any adjustments or speciai connections that are required at a specific site should be kept to a minimum and also kept as simple as possible. Hardware elements incorporated in equipment to permit utilizing the local power sources should also be as simple and inexpensive as possible.

The problem (i.e., providing connectability to a variety of voltage and frequency combinations) is exacerbated when ferro-resonant transformers are incorporated in the equipment for pre-regulation and buffering against voltage dips and surges. In such cases, it is necessary to provide separate taps for each frequency even if the voltages are the same. When both frequency and voltage are taken into consideration, it is not unusual to find that at least three taps are required at each transformer primary. In the present invention, there is provided a mechanism for selecting the appropriate tap for a given input voltage and frequency.

SUMMARY OF THE INVENTION

Therefore, there is supplied by the present invention, a transformer tap changer. One of a plurality of taps of at least one transformer is selected by choosing a predetermined plug to mate with a predetermined jack. The connection arrangement between each transformer and a corresponding jack is such that each pin of a respective jack is operatively connected to a predetermined transformer tap of the corresponding transformer whereby the corresponding selectable taps of each of the transformers are connected to different pins of each of the corresponding jacks. Further, the starting tap of each transformer is operatively connected to the same pin of its corresponding jack. A plurality of plugs, the number of plugs corresponding to one less than the number of pins of the jacks, is included whereby each plug has a plurality of mating pin positions corresponding to the pins of the jack. Each mating pin of each plug which corresponds to the pin of the starting tap is operatively connected to a first supply terminal. Each plug has a different mating pin from all of the other plugs operatively connected to a second supply terminal.

Accordingly, it is an object of the present invention to provide a device for changing transformer taps to permit a predetermined equipment to operate with any one of a plurality of power sources, each power source having a different voltage.

It is still another object of the present invention to provide a device for changing transformer taps to permit a predetermined equipment to operate with one of a plurality of power sources, each power source having a different frequency.

It is still a further object of the present invention to provide a device for changing transformer taps to permit a predetermined equipment to operate with one of a plurality of power sources, each power source having a different combination of voltage and frequency.

It is yet another object of the present invention to provide an improved means for transformer primary tap selection in a three-phase power system intended for direct connection to different voltage and frequency sources.

It is still a further object of the present invention to provide primary tap selection capability in a form which permits easy conversion at a local site for adaptation to the particular voltage and frequency combination that is available at that location.

These and other objects of the present invention will become more apparent when taken in conjunction with the following description and attached drawings, wherein like characters indicate like parts, and which drawings form a part of the present application.

DETAILED DESCRIPTION

There are many prior art approaches for selecting transformer primary taps. One such prior art approach includes having the transformer primary taps wired to terminal strips (not shown). Source voltage connections are then wired, one at a time, to the appropriate positions of the terminal strips.

Figure 1:
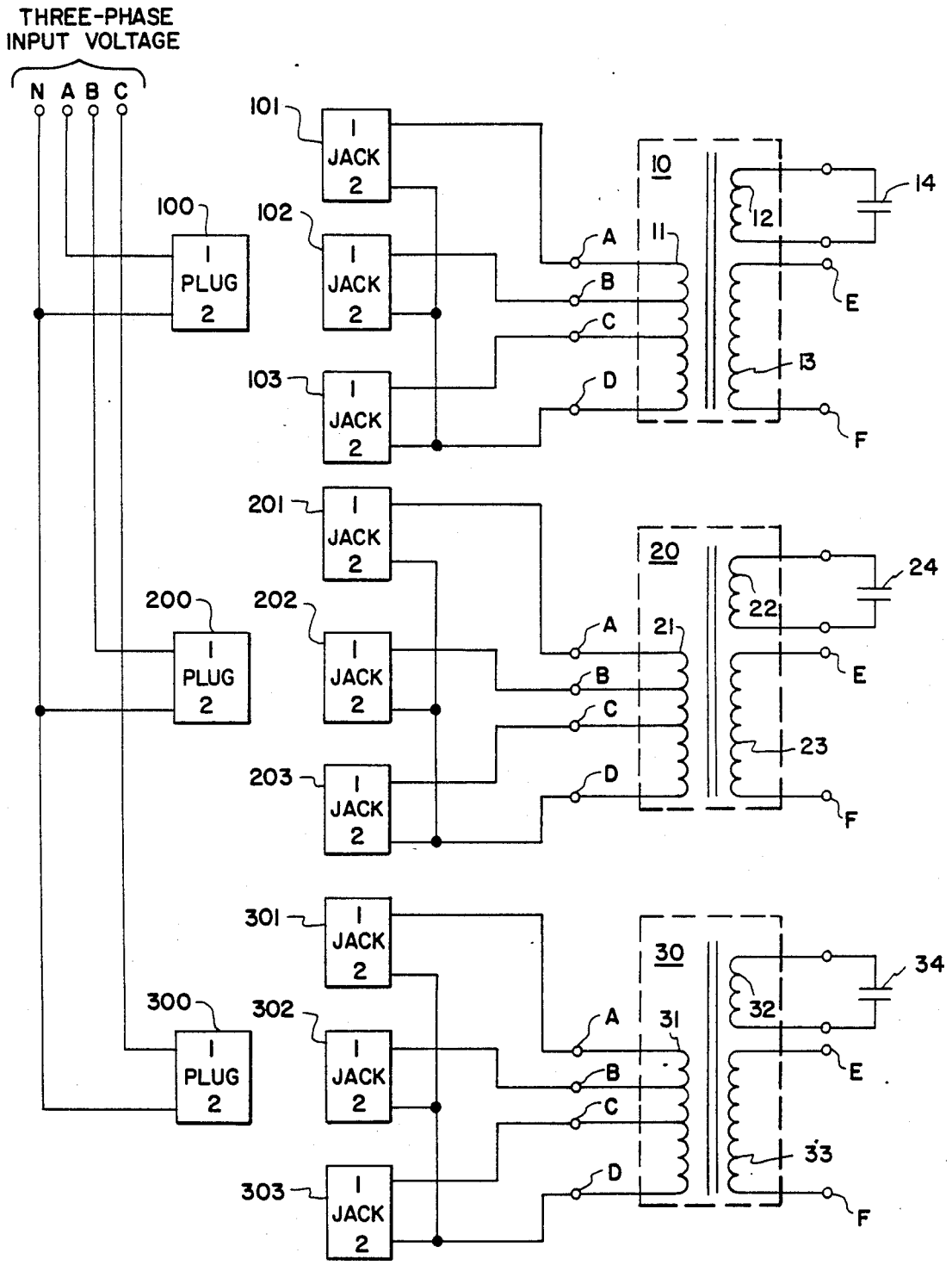
Fig. 1 PRIOR ART
FIG. 1 shows a prior art approach for the selection of transformer primary taps.

Referring to FIG. 1, there is shown another prior art approach for the selection of transformer primary taps, and is an approach commonly employed. Three ferro-resonant transformers (or more simply, transformers) 10, 20, 30, are connected to a three-phase four-wire power source having a neutral wire N and three-phase conductors A, B, and C. Each transformer 10, 20, 30 has a primary winding 11, 21, 31, a secondary winding 13, 23, 33, and a capacitor winding 12, 22, 32, respectively. Each primary winding 11, 21, 31 has at one end of the winding a start terminal, D. Each primary winding 11, 21, 31, has three taps along the winding, identified as terminals A, B, and C, (the terminals also being referred to as taps), tap A also being the termination of the respective primary winding 11, 21, 31. A tuning capacitor 14, 24, 34, is connected across the capacitor winding 12, 22, 32 of each transformer 10, 20, 30, respectively. An output voltage is supplied at terminals E, F, of each of the secondary windings 13, 23, 33, of each of the transformers 10, 20, 30, the output voltage being rectified in many applications which can then be employed as a DC source for switching power supplies.

Associated with each of the transformers 10, 20, 30, are three jacks and one plug which serve as a pluggable connection to the respective transformer. Thus, jacks 101, 102, 103, and plug 100 are associated with transformer 10, jacks 201, 202, 203 and plug 200 are associated with transformer 20, and jacks 301, 302, 303 and plug 300 are associated with transformer 30. The three jacks associated with a respective transformer provide a manner of selecting one of the taps A, B, or C. For a first transformer 10, start terminal D of primary winding 11 is connected to a pin 2 of all three jacks 101, 102, 103 associated with the first transformer 10. Tap A of first transformer 10 is connected to pin 1 of the first jack 101, tap B of first transformer 10 is connected to a pin 1 of the second jack 102, and tap C of transformer 10 is connected to pin 1 of the third jack 103. Plug 100 has a pin 1 connected to phase A of the three-phase input voltage, and a pin 2 connected to the neutral wire N. Thus, when plug 100 is plugged into the first jack 101, tap A is connected to phase A and start terminal D is connected to the neutral wire N. When plug 100 is plugged into the second jack 102, tap B is connected to phase A and start terminal D is connected to neutral wire N, and when plug 100 is plugged into the third jack 103, tap C is connected to phase A and start terminal D is connected to neutral wire N. In this manner, the input voltage phase A (A-N) of the three-phase input voltage can be connected to tap A, tap B, or tap C, as a function of which one of the jacks 101, 102, 103, is plugged into by plug 100.

In a similar manner, transformer 20 is connected to phase B of the three-phase input voltage, the tap selection being made by plugging plug 200 into jack 201, jack 202, or jack 203 and transformer 30 is connected to phase C of the three-phase input voltage, the tap selection being made by plugging plug 300 into jack 301, jack 302, or jack 303.

The tap to be selected, tap A, tap B, or tap C, is dependent upon the phase input voltage amplitude and frequency such that a predetermined output voltage is obtained which is within the operating range of the power supplies which are operatively connected to the respective output terminals E-F of the secondary windings 13, 23, 33. It will be understood by those skilled in the art that more taps and associated jacks can be provided to insure the achieving of the predetermined output voltage.

Figure 2:
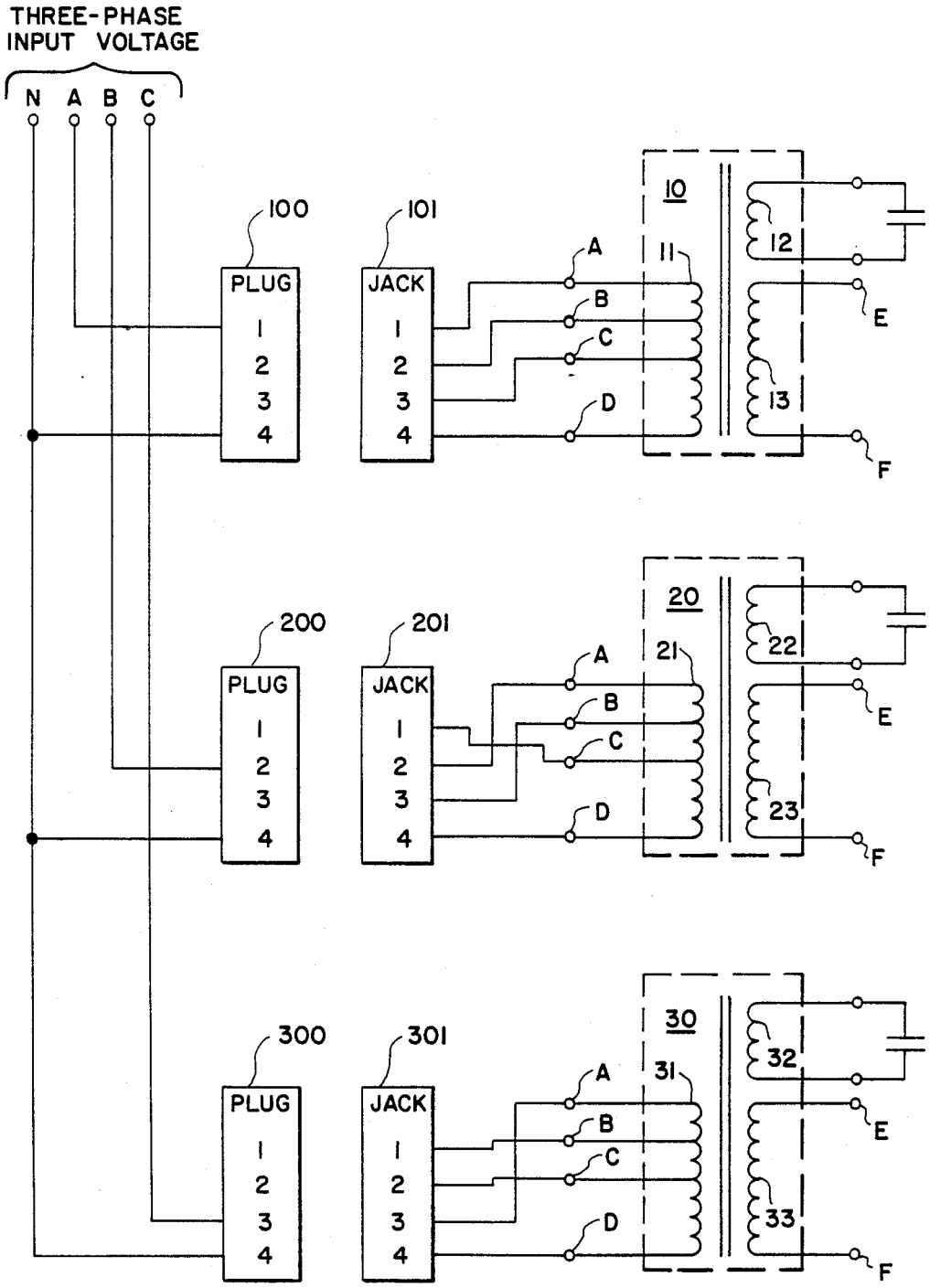
FIG. 2 shows an improved tap selection of the preferred embodiment of the present invention.

Referring to FIG. 2, there is shown an improved tap selection of the present invention. Each of the three transformers 10, 20, 30 has an associated jack 101, 201, 301, and an associated plug, 100, 200, 300. In the preferred embodiment of the present invention each jack has four pins, and each transformer is operatively connected to its respective jack differently. Also, each plug is connected to the input voltage differently. Thus, transformer 10 has tap A, tap B, tap C, and tap D, operatively connected to pin 1, pin 2, pin 3, and pin 4, respectively, of jack 101, transformer 20 has tap A, tap B, tap C, and tap D, operatively connected to pin 2, pin 3, pin 1, and pin 4, respectively, and transformer 30 has tap A, tap B, tap C, and tap D operatively connected to pin 3, pin 1, pin 2, and pin 4, respectively. Each plug 100, 200, 300, has four pins, pin 4 of each plug being connected to the neutral wire N. Pin 1 of plug 100 is connected to the input voltage phase A, pin 2 of plug 200 is connected to input voltage phase B, and pin 3 of plug 300 is connected to the input voltage phase C. In order to select tap A, plug 100 is connected to jack 101, plug 200 is plugged into jack 201, and plug 300 is plugged into jack 301. In order to select tap B, of each of the transformers 10, 20, 30, plug 100 is plugged into jack 301, plug 200 is plugged into jack 101, and plug 300 is plugged into plug 201. Lastly, in order to select tap C of each of the transformers 10, 20, 30, plug 100 is plugged into jack 201, plug 200 is plugged into jack 301, and plug 300 is plugged into jack 101, the plugging arrangement for the tap selections being shown in Table 1.

TABLE

| TAP SELECTIONS | | | | | |
|---|---|---|---|---|---|
| SELECT TAP A | | SELECT TAP B | | SELECT TAP C | |
| PLUG | JACK | PLUG | JACK | PLUG | JACK |
| 100 | 101 | 100 | 301 | 100 | 201 |
| 200 | 201 | 200 | 101 | 200 | 301 |
| 300 | 301 | 300 | 201 | 300 | 101 |

Thus, it can be seen that the tap selection functionality is achieved through a novel wiring arrangement in which the transformer taps A, B, and C are wired to different pins of the respective jacks 101, 102, 103, and the three-phase connections of the three-phase input voltage are connected to different pins of each of the respective plugs 100, 200, 300. The tap selection in the preferred embodiment of the present invention is then made by mating the plugs 100, 200, 300 with the appropriate jack 101, 201, 301, as described above. It will be understood by those skilled in the art that a three-phase input voltage is not required, but the input voltage can be single-phase, in which case phase A, phase B and phase C are essentially the same input voltage lead. A similar selection approach could also be employed to select output taps. Further, it will be understood by those skilled in the art that additional taps may be utilized with respective increase in the number of pins per jack, and will be shown and described hereinunder. Additional transformers may be utilized with additional jacks and corresponding plugs.

In the preferred embodiment of the present invention, it can be readily seen that the number of jacks is substantially reduced over that of the prior art configuration. In a set of p transformers, each with a start lead and n individually selectable taps, the selection apparatus of the prior art requires p jacks and nxp plugs (or p plugs and nxp jacks). The selection apparatus of the present invention also requires p jacks, but only n plugs, provided n is equal to or greater than p (for n less than p, p jacks and p plugs are required). It will be recognized that for the case of only one transformer (i.e., $p=1$) the present invention does not apply.

Figure 3:
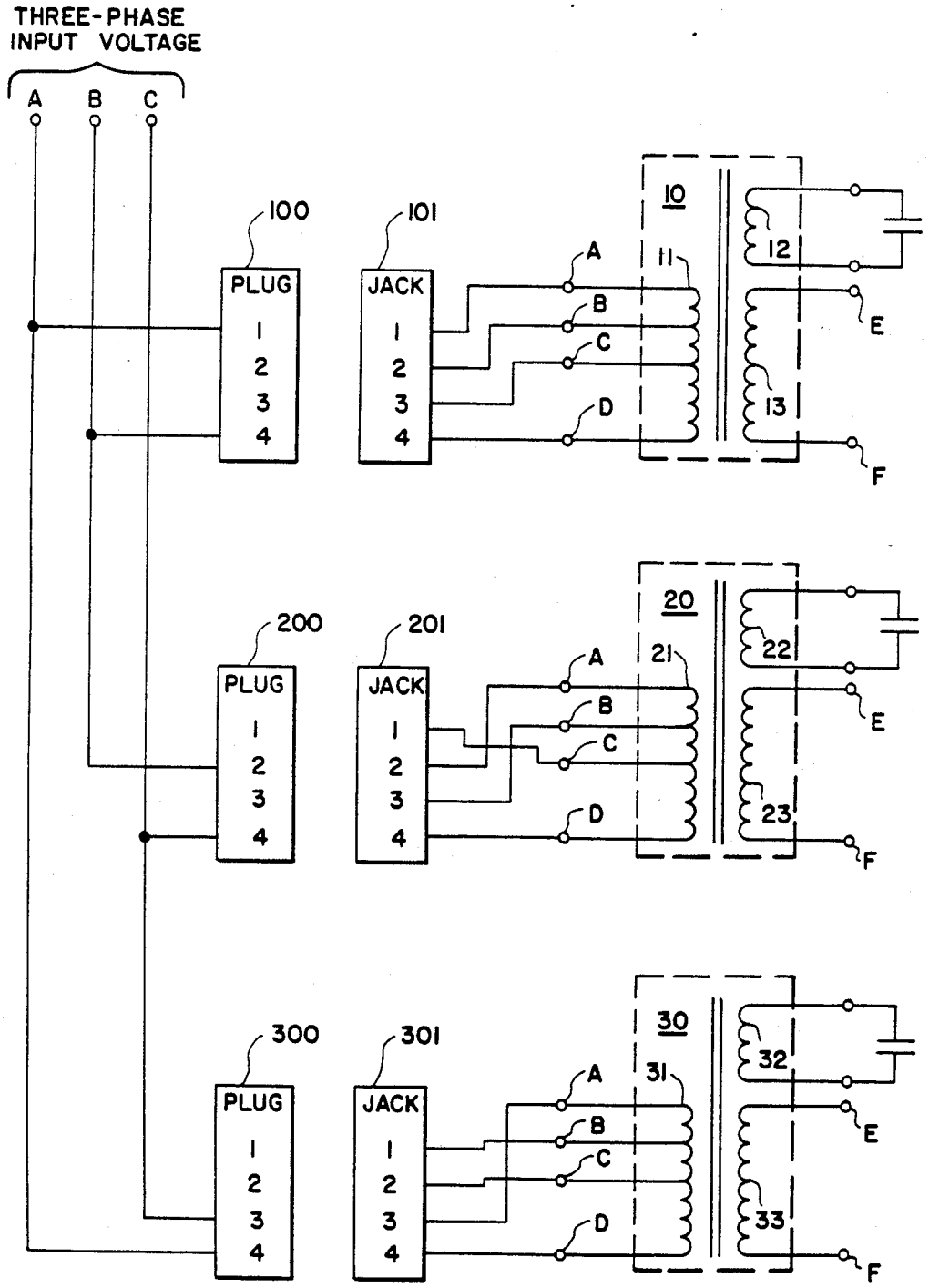
FIG. 3 shows a tap selection similar to the tap selection configuration of FIG. 2, but utilizing a three-phase delta-connection input rather than the Y-connection.

FIG. 3 shows the same tap selection as discussed above in conjunction with FIG. 2 but is utilized for a three-phase delta connection input rather than the Y configuration. Provision is frequently made for connection of a given set of transformer primary winding in either a delta or a Y-configuration, i.e., line-to-line or line-to-neutral. This option aids in reducing the number of transformer primary voltage ratings that are required.

Figure 4:
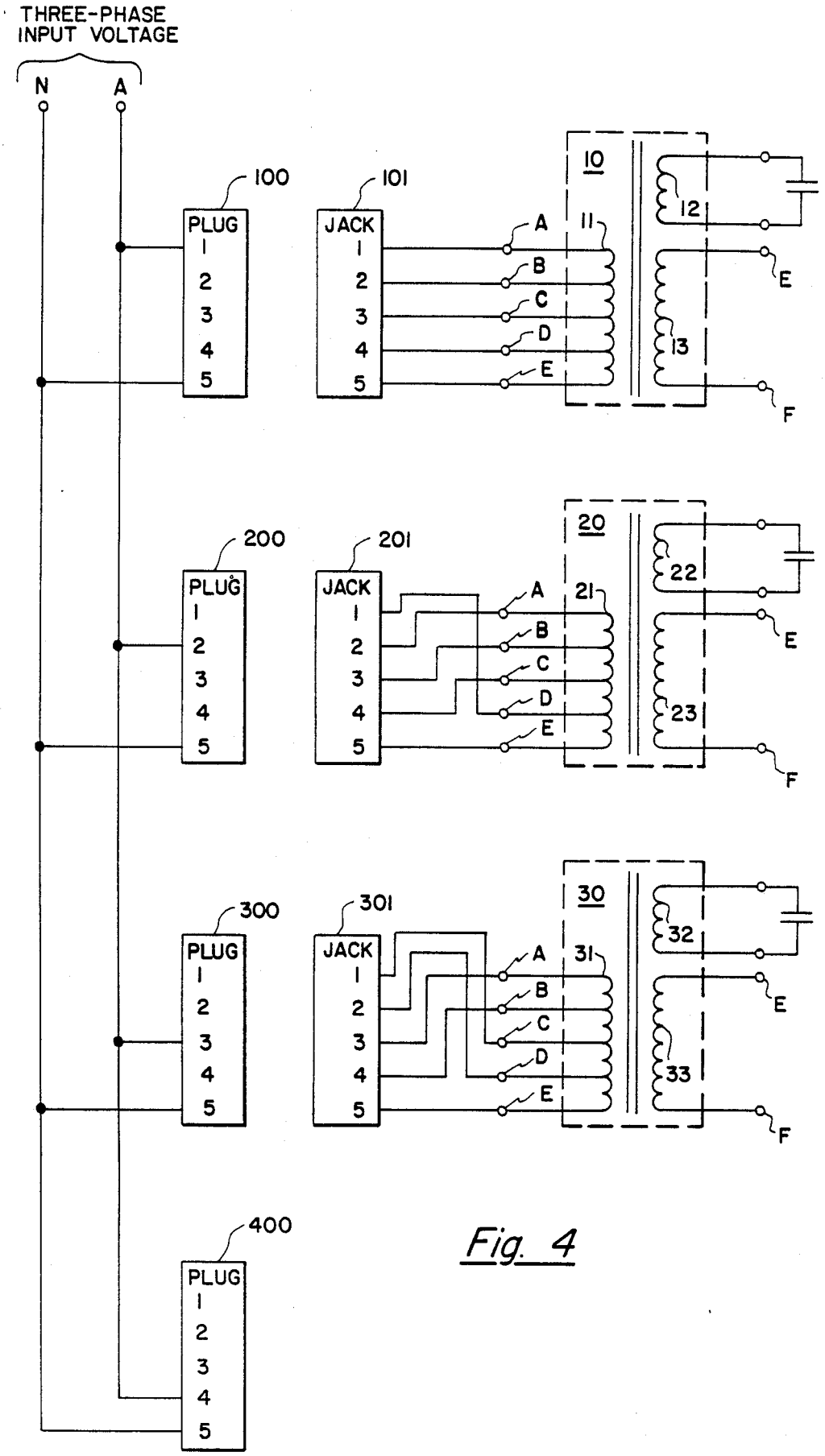
FIGS. 4 and 5 show an arrangement similar to that of FIG. 2 but include additional taps of the transformers.
Figure 5:
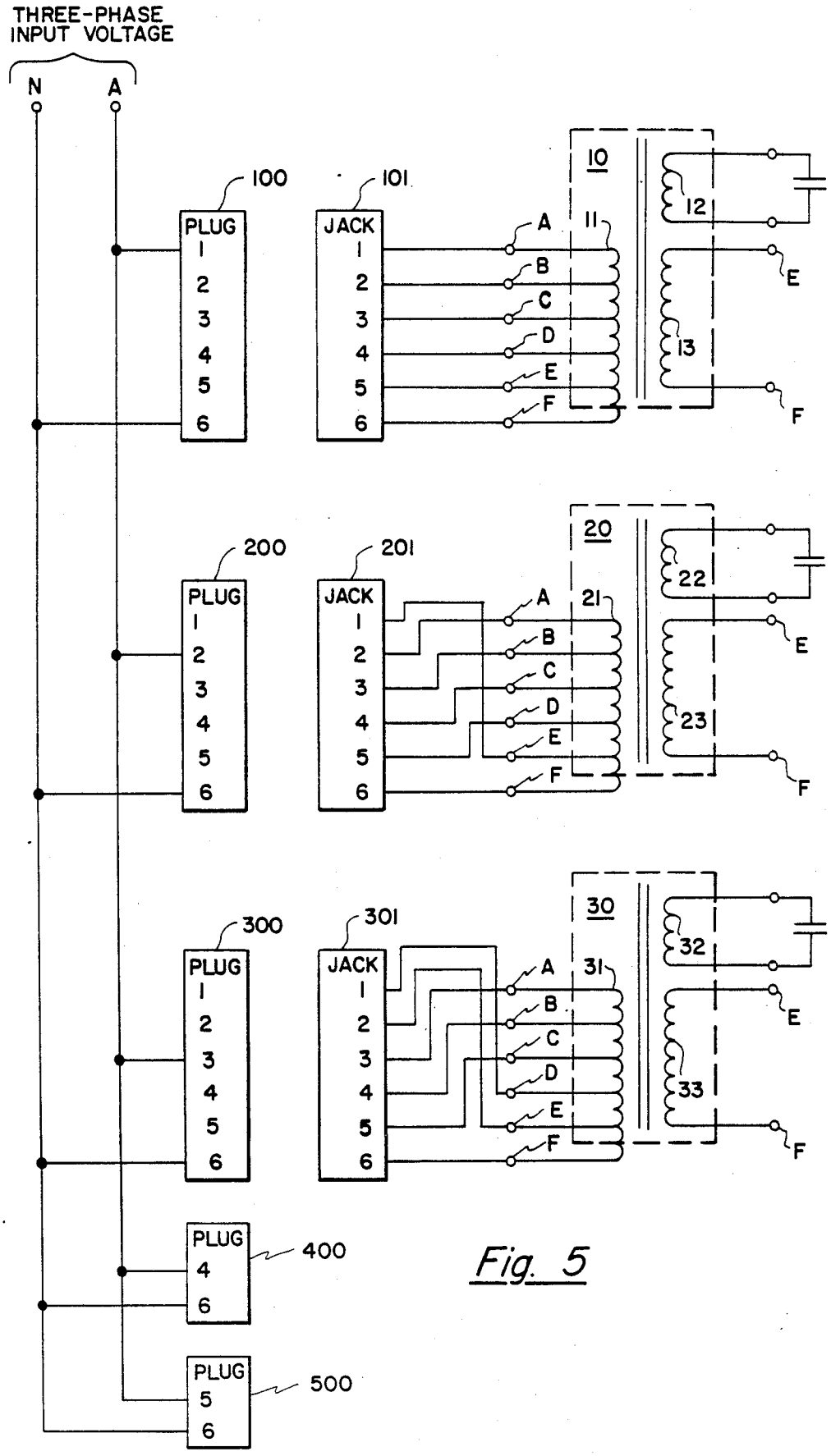

Referring to FIG. 4, there is shown an arrangement similar to that described above in conjunction with FIG. 2 but the transformers have an additional tap. In this case the respective jacks 101, 201, 301 and the corresponding plugs 100, 200, 300 have five pins. In addition, an additional plug 400, also having five pins, is included. The input voltage shows a single phase input voltage, but those skilled in the art can readily understand a configuration utilizing a three-phase input voltage as described above. The connection for the taps A through E of the transformers to the respective jack pins, 1 through 5, is shown in Table 2. In the table, it can be readily seen that tap A of transformer 10, tap A of transformer 20, tap A of transformer 30, and tap A of transformer 40 (not shown) are each connected to a different pin of their respective jack. Thus, tap A of transformer 10 is connected to pin 1 of jack 101, tap A of transformer 20 is connected to pin 2 of jack 201, tap A of transformer 30 is connected to pin 3 of jack 301, and tap A of transformer 40 (not shown). is connected to pin 4 of jack 401 (not shown). Likewise, a similar arrangement is made for each of the other taps with their connection to their respective jack. In this case, plug 400 is required in order to insure all four input tap, A through D of the three transformers 10, 20, 30 will be utilized. However, it is not necessary that a fourth transformer, transformer 40, and the corresponding jack 401 of transformer 40 be utilized. The connection of the plug to the jack for the selection of a predetermined tap of the transformer is shown in Table 3. FIG. 5 shows an arrangement in which the transformers 10, 20, 30 utilize six taps, i.e., five selectable input taps. Table 4 shows the connections between the taps of the transformers 10, 20, 30 and the pins of the corresponding jack of the configuration of FIG. 5. The plug-jack connection for the selection of a predetermined tap of the 6-tap transformers of FIG. 5 is shown in Table 5. Again, plug 400, 500 are required in order to insure all the taps of the transformers may be utilized, although the additional transformers, transformer 40, 50, and their respective jacks, are not required and hence are not shown. It will be noted that the tap-pin connections of each of the transformers revolves so that each transformer is wired differently to its respective jack.

TABLE 2

| TAP CONNECTION | | | | | | | |
|---|---|---|---|---|---|---|---|
| TAP OF TRANS-FORMER 10 | PIN OF JACK 101 | TAP OF TRANS-FORMER 20 | PIN OF JACK 201 | TAP OF TRANS-FORMER 30 | PIN OF JACK 301 | TAP OF TRANS-FORMER 40 | PIN OF JACK 401 |
| A | 1 | A | 2 | A | 3 | A | 4 |
| B | 2 | B | 3 | B | 4 | B | 1 |
| C | 3 | C | 4 | C | 1 | C | 2 |
| D | 4 | D | 1 | D | 2 | D | 3 |

TABLE 3

| TAP SELECTION | | | | | | | |
|---|---|---|---|---|---|---|---|
| SELECT TAP A | | SELECT TAB B | | SELECT TAP C | | SELECT TAP D | |
| PLUG | JACK | PLUG | JACK | PLUG | JACK | PLUG | JACK |
| 100 | 101 | 100 | — | 100 | 301 | 100 | 201 |
| 200 | 201 | 200 | 101 | 200 | — | 200 | 301 |
| 300 | 301 | 300 | 201 | 300 | 101 | 300 | — |
| 400 | — | 400 | 301 | 400 | 201 | 400 | 101 |

TABLE 4

| TAP CONNECTION | | | | | | | | | |
|---|---|---|---|---|---|---|---|---|---|
| TAP OF TRANS-FORMER 10 | PIN OF JACK 101 | TAP OF TRANS-FORMER 20 | TAP OF JACK 201 | TAP OF TRANS-FORMER 30 | PIN OF JACK 301 | TAP OF TRANS-FORMER 40 | TAP OF JACK 401 | TAP OF TRANS-FORMER 50 | PIN OF JACK 501 |
| A | 1 | A | 2 | A | 3 | A | 4 | A | 5 |
| B | 2 | B | 3 | B | 4 | B | 5 | B | 1 |
| C | 3 | C | 4 | C | 5 | C | 1 | C | 2 |
| D | 4 | D | 5 | D | 1 | D | 2 | D | 3 |
| E | 5 | E | 1 | E | 2 | E | 3 | E | 4 |

TABLE 5

| TAP SELECTION | | | | | | | | | |
|---|---|---|---|---|---|---|---|---|---|
| SELECT TAP A | | SELECT TAB B | | SELECT TAP C | | SELECT TAP D | | SELECT TAP E | |
| PLUG | JACK | PLUG | JACK | PLUG | JACK | PLUG | JACK | PLUG | JACK |
| 100 | 101 | 100 | — | 100 | — | 100 | 301 | 100 | 201 |
| 200 | 201 | 200 | 101 | 200 | — | 200 | — | 200 | 301 |
| 300 | 301 | 300 | 201 | 300 | 101 | 300 | — | 300 | — |
| 400 | — | 400 | 301 | 400 | 201 | 400 | 101 | 400 | — |
| 500 | — | 500 | — | 500 | 301 | 500 | 201 | 500 | 101 |

While there has been shown what is considered the preferred embodiment of the present invention, it will be manifest that many changes and modifications can be made therein without departing from the essential spirit and scope of the invention. It is intended, therefore, in the annexed claims to cover all such changes and modifications which fall within the true scope of the invention.

I claim:

1. A transformer apparatus selecting one of a plurality of taps of at least two transformers, said transformer taps being taps of a winding of each of said transformers, one of said transformer taps of each of said transformers being a starting tap of said winding and the remaining taps being the selectable taps, said apparatus comprising:

(a) a plurality of jack means each jack means being associated with one of the transformers, each jack means having a plurality of pins corresponding to the plurality of taps, each of said jack means for providing a contact point for each tap of the corresponding transformer, each pin of a respective jack means operatively connected to a predetrmined selectable transformer tap of a corresponding transformer, such that the corresponding selectable taps of each of the transformers is operatively connected to a different corresponding pin for each of the corresponding jack means, and further wherein the starting tap of each transformer is operatively connected to the same corresponding pin of the jack means corresponding to the transformer; and (b) a plurality of plug means, the number of plug means corresponding to one less than the number of pins of said jack means, each plug means having a plurality of mating pin positions corresponding to the pins of said jack means, the mating pin of each plug means that corresponds with the pin of the starting tap being operatively connected to a first supply terminal, and each plug means having a different mating pin from all the other plug means operatively connected to a second supply terminal, for mating with said jack means, such that when a predetermined plug means mates with a predetermined jack means, a predetermined tap is selected.

2. A transformer apparatus selecting one of n taps of p transformers, wherein each transformer has n+1 taps, the (n+1)st tap being the starting tap, said transformer taps being taps of a winding of each of said transformers, said apparatus comprising:

(a) a plurality of jack means, each jack means being associated with one of the transformers, each jack means having n+1 pins, the pins of each jack means corresponding to the taps of the corresponding transformer such that the $(n+1)^{st}$ pin is operatively connected to the starting tap, each of said jack means for providing a contact point for each tap of the corresponding transformer, each pin of a respective jack means operatively connected to a predetermined transformer tap of a corresponding transformer, such that the corresponding taps of each of the transformers is operatively connected to a different corresponding pin for each of the corresponding jack means such that the connections for the $p^{th}$ transformer revolve one position from that of the $(p-1)^{st}$ transformer; and (b) a plurality of plug means, the number of plug means being n, which is one less than the number of pins of said jack means, each plug means having n+1 mating pins corresponding to the pins of said jack means, each $(n+1)^{st}$ mating pin of each plug means corresponding to the pin of the starting tap being operatively connected to a first supply terminal, and the $i^{th}$ mating pin from each of the $i^{th}$ plug means (where i varies from 1 to n) being operatively connected to a second supply terminal, for mating with said jack means, such that when a predetermined plug means mates with a predetermined jack means, a predetermined tap is selected.

3. A three-phase power source in combination with a transformer apparatus selecting one of three taps of a first, a second, and a third transformer, said transformer taps being taps of a winding of each of said transformers, and including a fourth tap of each of said transformers said fourth tap being a starting tap of said winding, said apparatus being supplied by a three-phase power source, comprising:

(a) first, second, and third jack means, each jack means associated, respectively, with the first, second and third transformers, each jack means having a first, second, third and fourth pin corresponding with the taps of the associated transformer, each of said jack means providing a contact point for each tap of the associated transformer, each pin of a respective jack means being operatively connected to a predetermined transformer tap of an associated transformer, such that said first, second and third taps of said first transformer are operatively connected, respectively, to said first, second and third pins of said first jack means, said first, second and third taps of said second transformer are operatively connected, respectively, to said second, third and first pins of said second jack means, said first, second and third taps of said third transformer are operatively connected, respectively, to said third, first and second pins of said third jack means, and said fourth tap of each of said three transformers is operatively connected to said fourth pin of the associated jack means; and (b) first, second and third plug means, each plug means having first and second mating pins and first, second, third and fourth mating pin positions corresponding with the four pins of said jack means, said first pin being installed in said fourth mating pin position of each plug means corresponding to the fourth pin position of said jack means to which the starting tap of the associated transformer is connected, said second pin of said first plug means being installed in said first position, said second pin of said second plug means being installed in said second pin position, and said second pin of said third plug mens being installed in said third pin position, said first and second pins of each of said three plug means being operatively connectable across one phase of the three-phase power source, such that when said first, second and third plug means are installed, respectively, in said first, second and third jack means, said first and said fourth taps of each transformer are selected, when said first, second and third plug means are installed, respectively, in said second, third and first jack means, said third and said fourth taps of each transformer are selected, and when said first, second and third plug means are installed, respectively, in said third, first and second jack means, said second and fourth taps of each transformer are selected.

4. The apparatus of claim 3 wherein said three-phase power source is a delta configuration and said first and second pins of said jack means are operatively connected line-to-line.

5. The apparatus of claim 3 wherein said three-phase power source is a Y configuration having three-phase wires and a neutral wire and said first and second pins of each of said jack means are operatively connected between one of said phase wires and said neutral wire.

* * * * *